US007328811B2

(12) United States Patent
Roodenburg et al.

(10) Patent No.: US 7,328,811 B2
(45) Date of Patent: Feb. 12, 2008

(54) EVEN REEVING SYSTEM

(75) Inventors: Joop Roodenburg, Delft (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 11/612,305

(22) Filed: Dec. 18, 2006

(65) Prior Publication Data

US 2007/0084815 A1 Apr. 19, 2007

Related U.S. Application Data

(63) Continuation-in-part of application No. PCT/NL05/00443, filed on Jun. 17, 2005.

(51) Int. Cl.
*B66C 23/00* (2006.01)

(52) U.S. Cl. ..... 212/252; 212/232; 212/309

(58) Field of Classification Search ..... 212/232, 212/239–240, 252, 309
See application file for complete search history.

(56) References Cited

U.S. PATENT DOCUMENTS 3,486,635 A * 12/1969 Thomson ..... 212/310
3,620,504 A * 11/1971 Morrison ..... 254/399
3,777,901 A * 12/1973 Morrison ..... 212/310
4,221,300 A * 9/1980 Rudak et al. ..... 212/309
4,506,791 A * 3/1985 Brosigke ..... 212/307
4,892,202 A * 1/1990 Hey et al. ..... 212/309
5,011,333 A 4/1991 Lanan et al.
5,579,931 A 12/1996 Zuehlke et al.

FOREIGN PATENT DOCUMENTS

| | | | |
|---|---|---|---|
| DE | 2642910 A1 | | 3/1978 |
| DE | 29 28 920 | * | 2/1980 |
| DE | 10016021 A1 | | 10/2001 |
| EP | 1063163 A | | 12/2000 |
| GB | 2025349 A | | 1/1980 |
| JP | 2001-354389 A | * | 12/2001 |
| NL | 8104269 A | | 4/1983 |
| NL | 8503094 A | | 6/1987 |

OTHER PUBLICATIONS

The Advantageous Heavy Lift Mass Crane (HLMC), 26, iro journaal 23, Jun. 12, 1987; pp. 26-29.

* cited by examiner

*Primary Examiner*—Thomas J. Brahan
(74) *Attorney, Agent, or Firm*—Buskop Law Group, PC; Wendy Buskop

(57) ABSTRACT

A hoisting crane with an even reeving system having a substantially hollow vertical column, which has a foot, a top and a body disposed between the foot and the top. An annular bearing structure disposed around the substantially hollow vertical column. A jib connection member disposed on the annular bearing structure and rotatable about the substantially hollow vertical column. A jib connected to the jib connection member.

8 Claims, 13 Drawing Sheets

EVEN REEVING SYSTEM

CROSS REFERENCE TO RELATED APPLICATIONS

The present application is a continuation-in-part application which claims priority to co-pending International Application Number PCT/NL2005/000443 filed on 17 Jun. 2005 entitled "Hoisting Crane and Offshore Vessel" which claims priority to Netherlands Application Number 1026458 filed Jun. 18, 2004.

FIELD

The present embodiments relate generally to a hoisting crane with an even reeving system for use with an offshore vessel, for offshore operations.

BACKGROUND

There exists a need for a hoisting crane with an even reeving system that has a movable winch support, which is movable relative to a substantially hollow vertical column.

There further exists a need for a hoisting crane that has a movable winch support that maintains a substantially constant orientation between a jib and the winch support.

The present embodiments meet these needs.

BRIEF DESCRIPTION OF THE DRAWINGS

The detailed description will be better understood in conjunction with the accompanying drawings.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

The embodiments of the invention relate generally to a hosting crane with a movable winch support. The hoisting crane will be described in further detail below.

Figure 1:
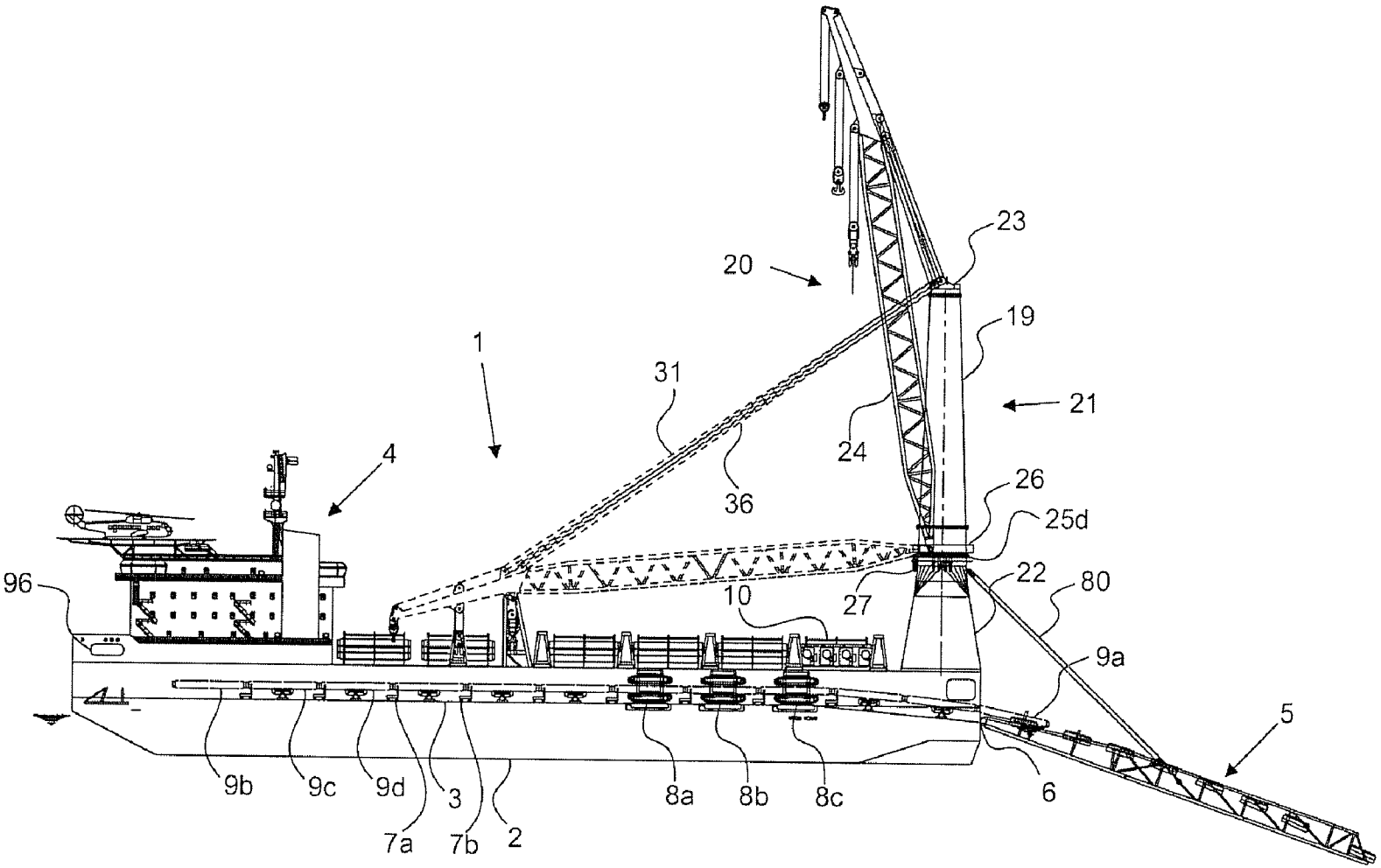
FIG. 1 diagrammatically depicts an offshore vessel which is suitable, inter alia, for laying a pipeline on the seabed.
Figure 2:
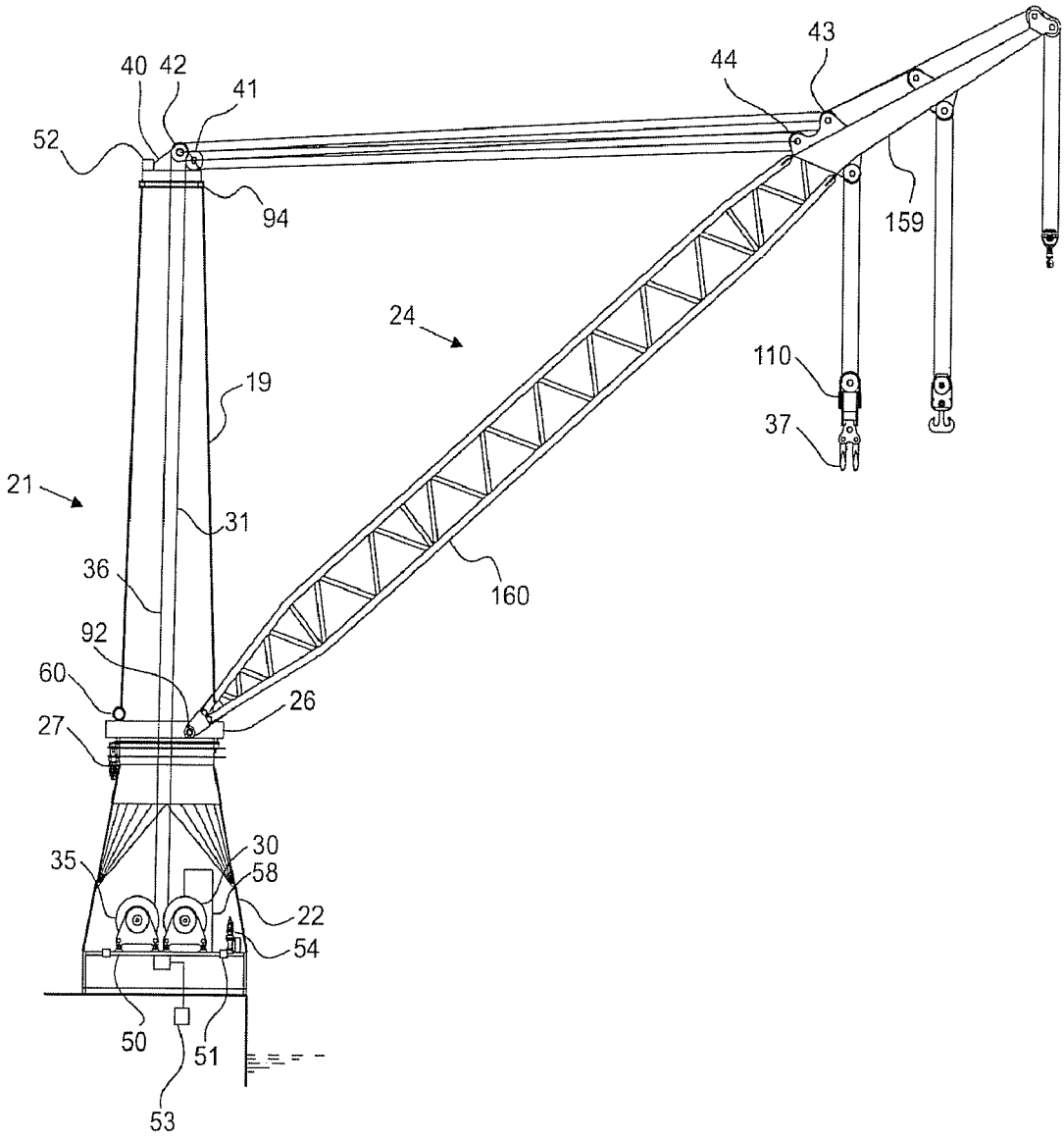
FIG. 2 shows the hoisting crane at the rear side of the vessel shown in FIG. 1, partially in the form of a cut-away view.
Figure 3:
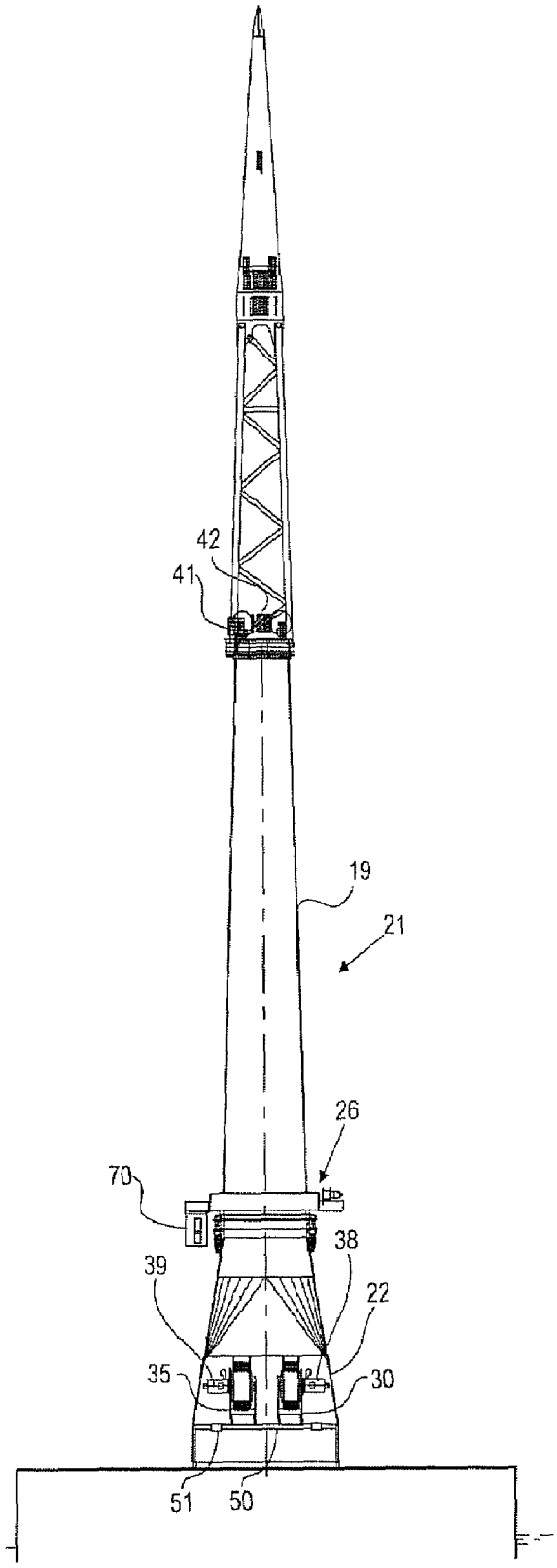
FIG. 3 shows the hoisting crane depicted in FIG. 2 from a different direction.
Figure 4:
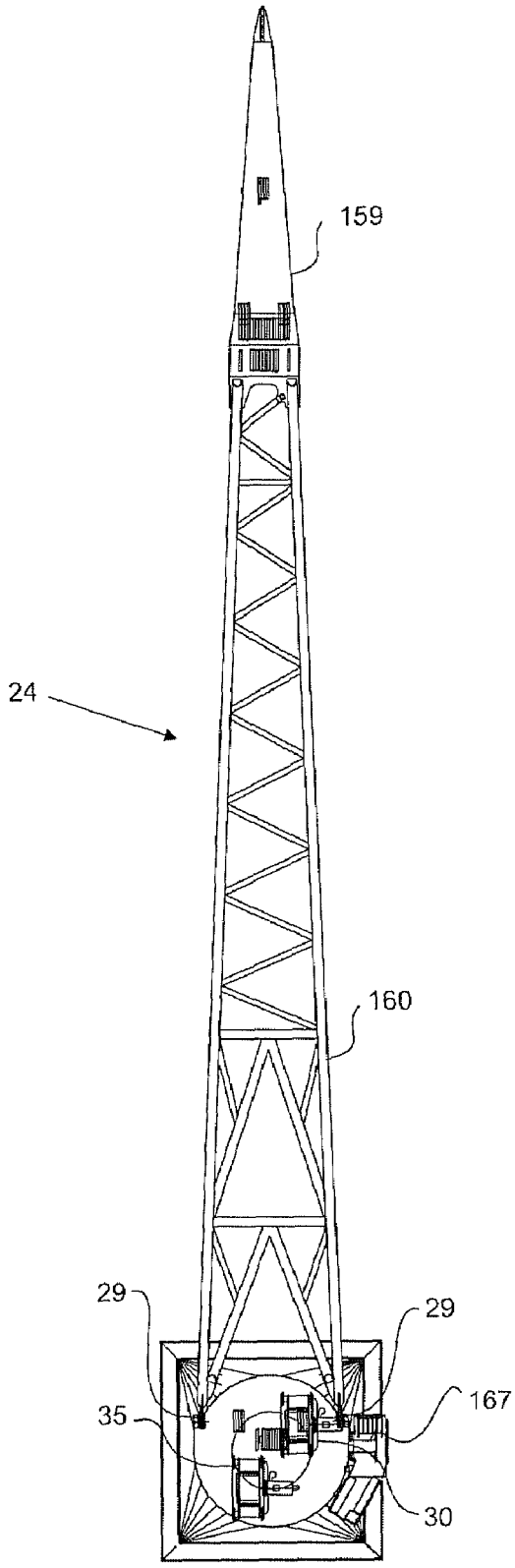
FIG. 4 shows an alternative view of the hoisting crane depicted in FIG. 2.

FIG. 1 shows an offshore vessel 1 which is suitable for laying a pipeline on the seabed. The vessel 1 has a hull 2 with a working deck 3 and a superstructure 4 for crew accommodation, at the front of the hull 2.

The offshore vessel 1 is provided with a pipeline-laying installation of the S-lay type, with one or more welding stations 7*a*, 7*b* on the working deck 3, for coupling pipeline sections 9*b*, 9*c*, 9*d* in a substantially horizontal orientation. On the working deck 3 there are also what are known as tensioners 8*a*, 8*b*, 8*c* for carrying the weight of the pipeline 9*a* which is hanging downward from the offshore vessel 1.

The offshore vessel 1 has a stinger 5 which projects outside the hull 2 of the offshore vessel 1 at the rear side of the offshore vessel 1. The stinger 5 engages on the hull 2 at an engagement point such that it can pivot about a substantially horizontal pivot structure 6 and forms a downwardly curved support for pipeline 9*a*.

The offshore vessel 1 has a hoisting crane 20, disposed in the vicinity of the same side of the hull 2 as the stinger 5. The hoisting crane 20 has a substantially hollow vertical column 21 having a foot 22, a top 23, and a body 19 disposed between the foot 22 and the top 23. The foot 22 is secured to the hull 2. The hoisting crane 20 will be described in more detail below. Here, the crane 20 is disposed above the location where the pipeline 9*a* leaves the working deck 3, on the longitudinal axis of the offshore vessel 1.

The hoisting crane 20 has a substantially hollow vertical column 21, which has the foot 22. In this embodiment, the foot 22 is secured to the hull 2. The substantially hollow vertical column 21 further has a body 19 disposed between the foot 22 and a top 23.

The hoisting crane 20 has a jib 24, which is illustrated in two different positions in FIG. 1. An annular bearing structure 25*d* extends around the substantially hollow vertical column 21 and guides and carries a jib connection member 26, so that the jib connection member 26, and the jib 24 can rotate about the substantially hollow vertical column 21.

The jib connection member 26 forms a substantially horizontal pivot axis 92, enabling the jib 24 to be pivoted from the foot toward the top, and from the top toward the foot. There is at least one drive motor 27 for displacing the jib connection member 26 along the annular bearing structure 25*d*.

For example, in an embodiment of the hoisting crane, the annular bearing structure 25*d* has one or more guide tracks which extend around the substantially hollow vertical column 21. The guide tracks support an annular component 28 of the jib connection member 26 by running wheels. Jib securing supports 29 are arranged on the annular component 28 at two positions. The drive motor 27 can, for example, drive a pinion which engages with a toothed track around the substantially hollow vertical column 21.

To pivot the jib 24 up and down, there is a topping winch 30 provided with a first topping cable 31 which engages on the jib 24.

In the embodiment of the hoisting crane 20 depicted in FIG. 1, at least one hoisting winch is used, which is depicted as a hoisting winch 35, for raising and lowering a load 10, with an associated hoisting cable 36 and a hoisting hook 37. At the top 23 of the substantially hollow vertical column 21 there is a top cable guide 40 provided with a topping cable pulley assembly 41 for the first topping cable 31 and with a hoisting cable pulley assembly 42 for the hoisting cable 36. The hoisting crane 20 can hoist more than one load.

One or more second hoisting cable pulley assembly 43 for the hoisting cable 36 and a second topping cable pulley assembly 44 for the first topping cable 31 are arranged on the jib 24. The number of cable parts for each cable can be selected as appropriate by one skilled in the art.

The topping winch 30 and the hoisting winch 35 are, in this embodiment, disposed in the foot 22 of the substantially hollow vertical column 21, so that the first topping cable 31 and the hoisting cable 36 extend from the topping winch 30 and the hoisting winch 35 upward, through the substantially hollow vertical column 21, to the topping cable pulley assembly 41 and the hoisting cable pulling assembly 42 and then toward the second hoisting cable pulley assemblies 43 and the second topping cable pulley assembly 44 on the jib 24. The jib 24 has a jib top 159 and a jib body 160.

The top cable guide 40 has a top cable guide annular bearing structure 94, for example, with one or more running tracks around the top of the substantially hollow vertical column 21 and running wheels. The top cable guide can follow rotary movements of the jib 24 about the substantially hollow vertical column 21 and adopt substantially the same angular position as the jib 24.

The top cable guide 40 can have an associated first drive motor assembly 52 which ensures that the top cable guide 40 follows the rotary movements of the jib 24 about the substantially hollow vertical column 21, but an embodiment without drive motor assembly is possible.

The topping winch 30 and the hoisting winch 35 are arranged on a movable winch support 50, which is mounted movably with respect to the substantially hollow vertical column 21. The movable winch support 50, as depicted, is located in the substantially hollow vertical column 21, preferably in the region of the foot 22 under the circular cross section part of the substantially hollow vertical column 21, and is mechanically decoupled from the top cable guide 40. The movable winch support 50 could, for example, also be arranged in the hull 2 of the vessel below the substantially hollow vertical column 21. For example, the foot 11 could have an extension which extends into the hull 2.

In the depicted embodiment, the movable winch support 50 is a substantially circular support which at its circumference is mounted in an annular bearing 51, with the topping winch 30 and hoisting winch 35 arranged on the support. The annular bearing 51 is, in this case, such that the support can rotate about a vertical axis which coincides with the axis of rotation of the top cable guide 40. The annular bearing 51 can have any appropriate design including trolleys ruining along a circular track.

The rotatable movable winch support 50 has an associated second drive motor assembly 54 for moving the movable winch support 50, in such a manner that the movable winch support 50 maintains a substantially constant orientation with respect to the jib 24 in the event of rotary movements of the jib 24 about the substantially hollow vertical column 21. The orientation of the movable winch support 50 with respect to the top cable guide 40 likewise remains substantially constant, since its movements are once again the consequence of rotary movements of the jib 24.

In the embodiment shown, there is an angle sensor 60 for detecting the position of the annular component 28 of the jib connection member 26 with respect to the substantially hollow vertical column 21. The second drive motor assembly 54 of the winch support 50 has associated control means 53 which are in operative contact with the angle sensor 60.

The topping winch 30 and hoisting winch 35 each have an associated electrical (or electro-hydraulic) first winch drive motor assembly 38 and a second winch drive motor assembly 39 which are disposed on the movable winch support 50. The electrical energy required is supplied by generators disposed elsewhere on the vessel 1, at a distance from the movable winch support 50. One or more sliding contacts are provided to create the electrical connection between these generators, the first winch drive motor assembly 38 and the second winch drive motor assembly 39.

In a variant which is not shown, the movable winch support 50 can rotate about a vertical shaft, this shaft being provided with one or more sliding contacts.

One or more sliding contacts are used to feed a power current supply to the electrical equipment on the movable winch support 50.

The hoisting crane 20 is provided with a cab 70 for a hoisting crane operator. The cab 70 is, in this case, carried by the jib connection member 26 to which the jib 24 is secured, so that the cab 70 can rotate with the jib 24 about the substantially hollow vertical column 21.

In the cab 70 there is at least one control member, also referred to as a winch operating member 167, for operating the hoisting winch 35 of the hoisting cable 36 and for operating the topping winch 30 of the first topping cable 31. The first winch drive motor assembly 38 and the second winch drive motor assembly 39 have associated control means 53 which are in wireless communication with the associated control members in the cab 70.

In an embodiment, a plurality of wireless transmission/reception units 168/169 are disposed around the substantially hollow vertical column 21, in or in the vicinity of the path of the cab 70 around the substantially hollow vertical column 21.

The control means 53, depicted as, for example, electronic control equipment 58, for the one or more winches on the movable winch support 50 are preferably also positioned on this movable winch support 50.

It can be seen from the figures that, as is preferred, the substantially hollow vertical column 21 has a substantially continuous outer wall. In this case, the horizontal section through the vertical column is substantially circular from the jib connection member 26 to the top 23, with the cross section gradually decreasing toward the top 23 of the substantially hollow vertical column 21.

The foot 22 of the substantially hollow vertical column 21 is substantially rectangular, which has the advantage that the foot 22 can easily be secured (by welding or using bolts) to the longitudinal and cross bulkheads of the hull 2 of the vessel 1. In a variant which is not shown, the substantially hollow vertical column is partly or completely a framework of bars.

Figure 5:
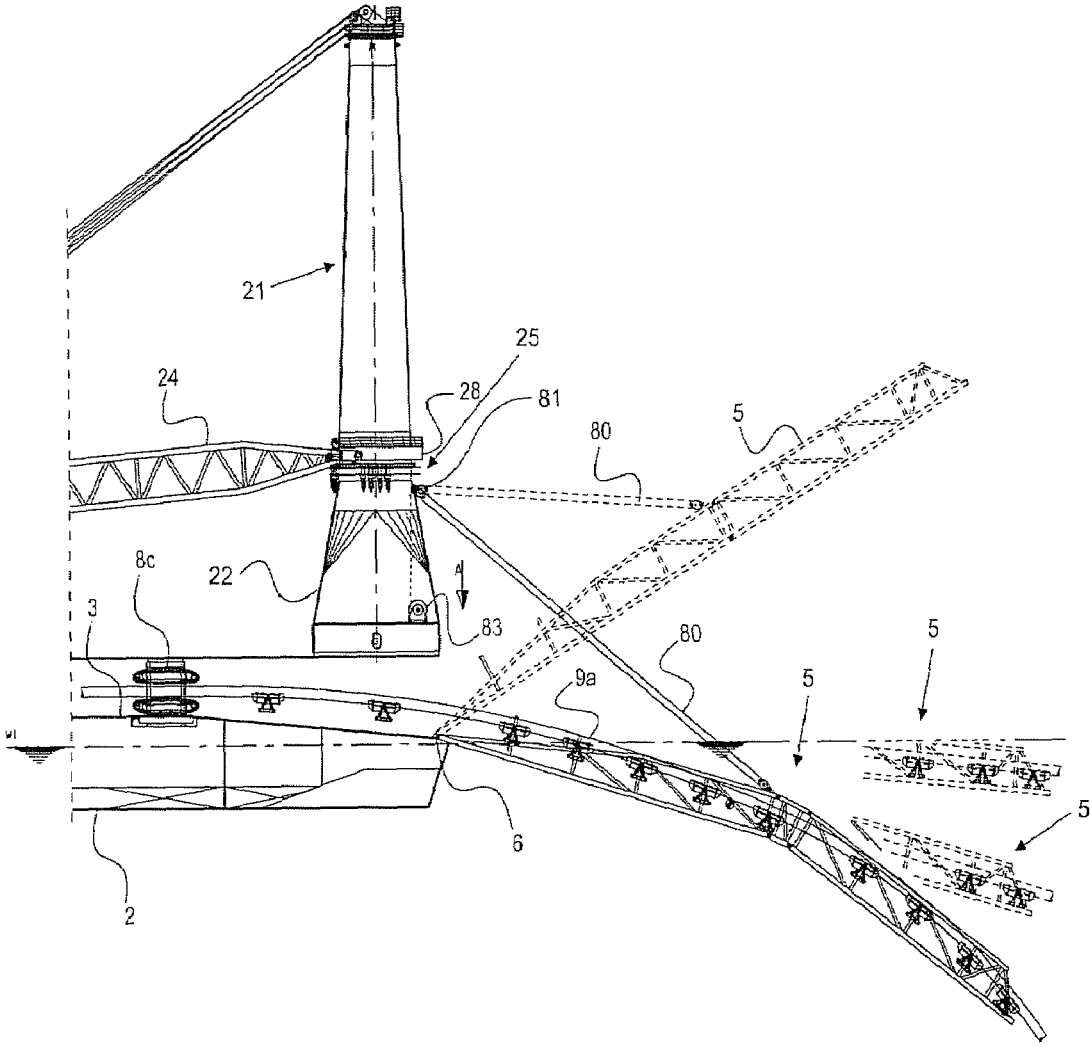
FIG. 5 shows the rear side of the vessel depicted in FIG. 1, with a stinger in various positions.
Figure 6:
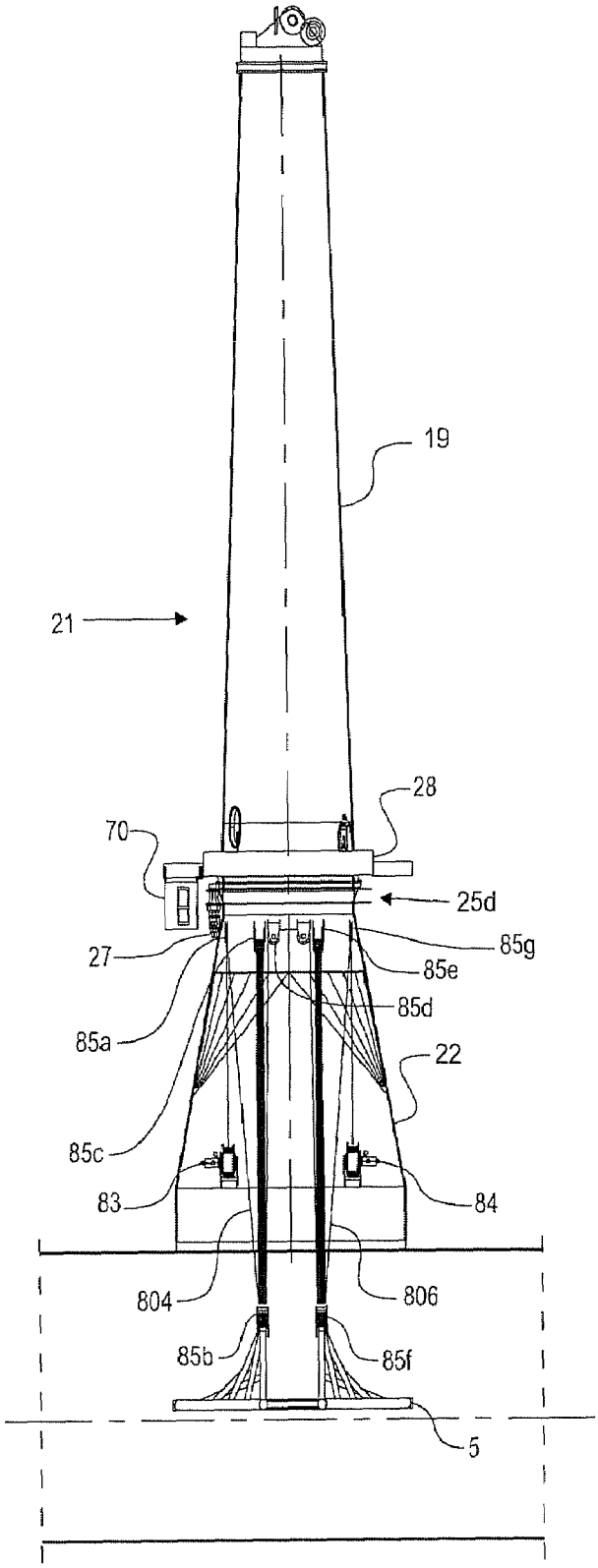
FIG. 6 shows the column of the crane and the stinger depicted in FIG. 5.
Figure 7:
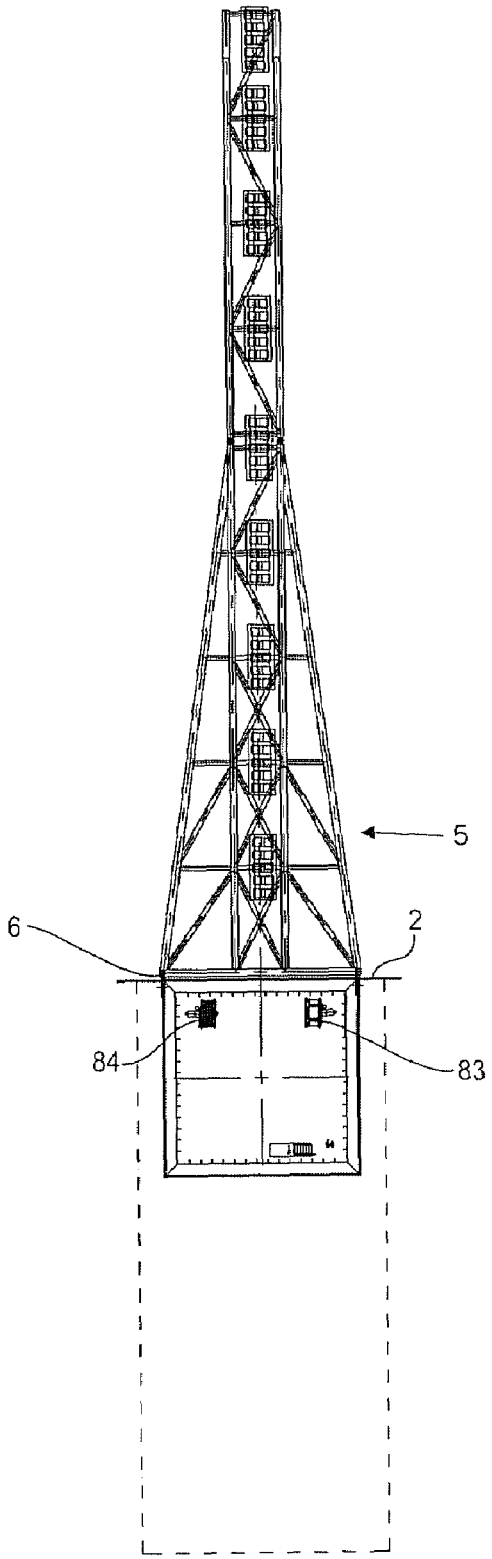
FIG. 7 shows a plan view of the stinger and part of the vessel 20.

It can be seen from FIG. 1 FIG. 5, and FIG. 6 that a load-bearing connecting structure 80, which holds the stinger 5 in a desired position, extends between the substantially hollow vertical column 21 of the hoisting crane 20 at an elevated position 81 relative to the horizontal pivot structure 6 of the stinger 5 on the vessel hull 2 (in this case in the vicinity of the annular bearing structure for the jib 24) and the stinger 5, at a location remote from the horizontal pivot structure 6 of the stinger on the vessel hull 2.

Using the substantially hollow vertical column 21, here the foot 22, of the hoisting crane 20 as a point of engagement for the load-bearing connecting structure 80 makes it possible to dispense with additional structural components for holding the stinger 5 in place, such as cantilevers projecting outside the hull 2.

This load-bearing connecting structure 80 is in this case formed by a cable system 800 with a first stinger winch 83, connected to a first stinger adjusting cable 804 and a second stinger winch 84 connected to a second stinger adjusting cable 806. The cable system 800 is located in the vicinity of lower end of the foot of the hosting crane 20 and with first stinger cable pulley assembly 85*a*, second stinger cable pulley assembly 85*b*, third stinger cable pulley assembly 85*c*, fourth stinger cable pulley assembly 85*d*, fifth stinger cable pulley assembly 85*e*, sixth stinger cable pulley assembly 85*f* and seventh stinger cable pulley assembly 85*g* on the upper end of the foot 22 of the hoisting crane 20 and on the stinger 5. As a result, the length of the load-bearing connecting structure 80 is adjustable for the purpose of adjusting the position of the stinger 5 thereof.

Figure 12:
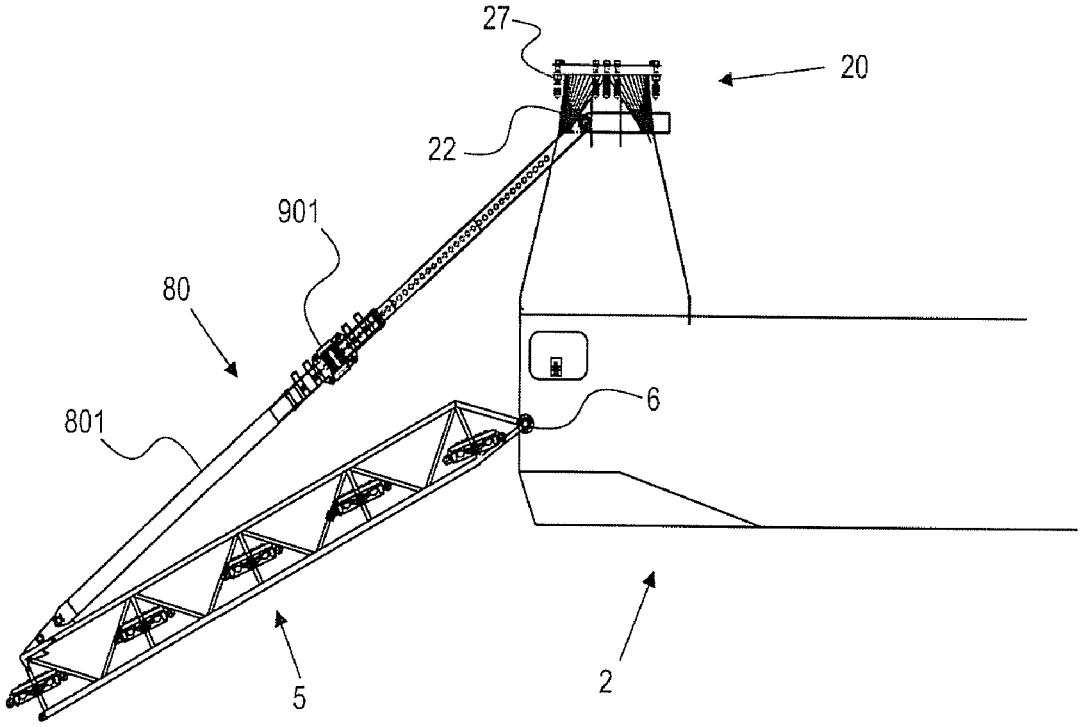
FIG. 12 shows an alternative support structure for the stinger.

As an alternative for the cable system, a system including adjusters, such as hydraulic adjustors, could be arranged between the substantially hollow vertical column 21 and the stinger 5, for example, including hydraulic jacks 901. Such a system is shown in FIG. 12, wherein a telescopic boom 801 is arranged between the stinger 5 and the substantially hollow vertical column 21, which is depicted in this example at the upper end of the foot. At least one hydraulic jack 901 can be provided to slide the telescopic boom 801 in and out.

The vessel 1 can be used to lay a pipeline 9*a*, but also for hoisting work, such as the hoisting work carried out, for example, in the offshore industry when installing supports, underwater installations.

Figure 13:
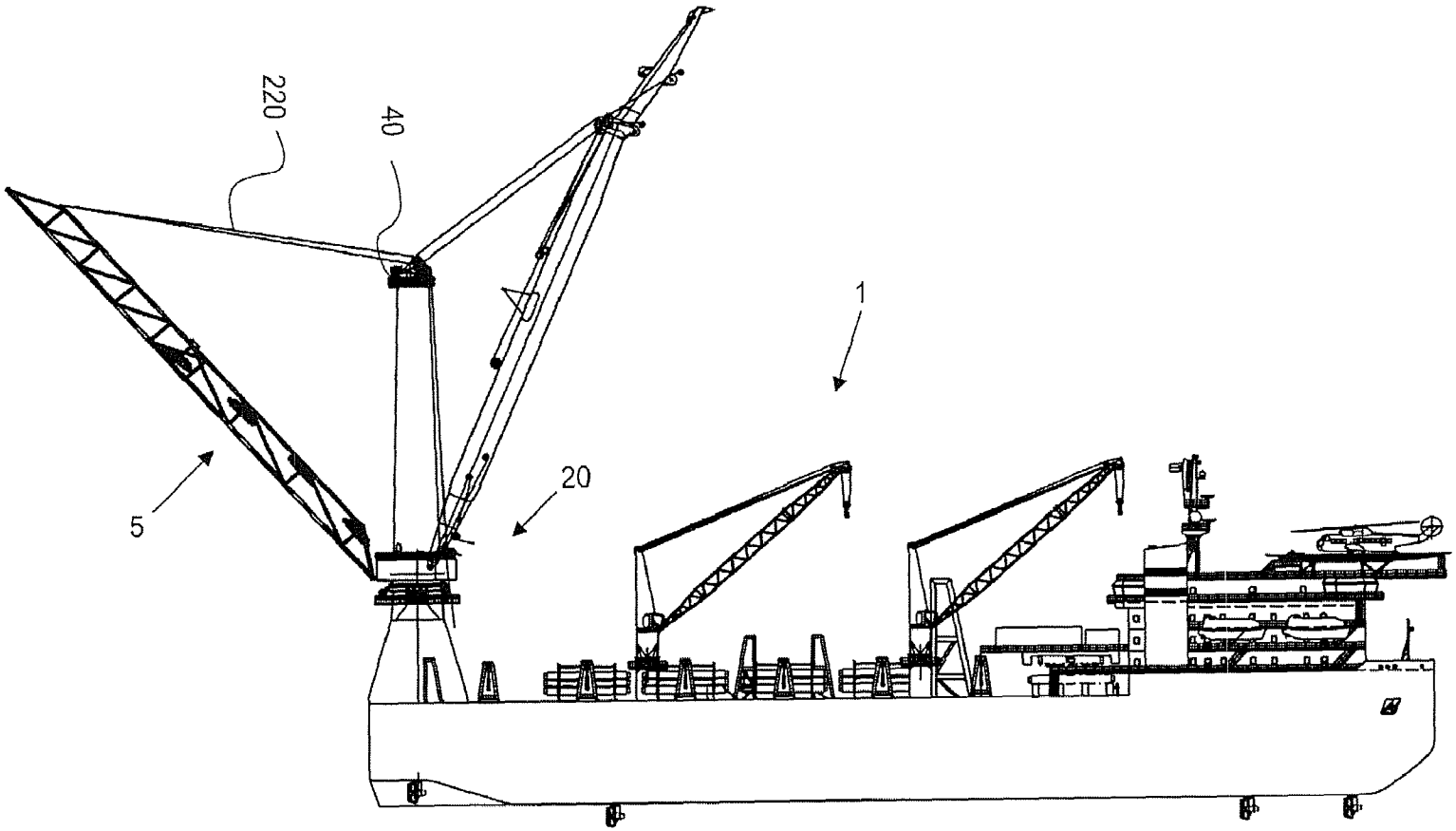
FIG. 13 shows the use of the stinger as counterweight in a lifting operation.

In an embodiment depicted in FIG. 13, it is contemplated that the stinger 5 of the vessel 1 is employed as a counterweight in a lifting operation using hosting crane 20. For this purpose, the stinger 5 could also be connected to the jib connection member 26 of the hosting crane 20.

In this example a second topping cable 220 is arranged between the stinger 5 and the top cable guide 40 of the hosting crane 20. It is noted that this method could be employed on other types of S-lay pipelaying vessels which have a hosting crane 20 and a stinger 5. It can also be envisaged that a further weight, e.g. a barge, can be suspended from the stinger 5 to effectively increase the counterweight.

The embodiments of the hosting crane can have at least one hoisting winch 35, however, an alternative embodiment of the hoisting crane 20 relates to an even reeving system. In this alternative embodiment, there is a first hosting winch 62 and a second hoisting winch 64.

In an embodiment, the hosting crane can have a substantially hollow vertical column with a foot, which can be secured to a vessel or other support structure. The hoisting crane further has a top and a body disposed between the foot and the top.

Further, in the present embodiment, the hosting crane can also have an annular bearing structure disposed around the substantially hollow vertical column. Additionally, a jib connection member is disposed on the annular bearing structure and rotatable about the substantially hollow vertical column. A jib is attached to the jib connection member.

In the present embodiment, a first hoisting winch is disposed on a moveable winch support. The first hoisting winch is connected to a first hoisting cable and a second hoisting winch is disposed on the moveable winch support connected to a second hoisting cable. Both hoisting cables pass through the interior of the substantially hollow vertical column to a top cable guide. The first hoisting cable engages a first hoisting cable pulley assembly.

The first hosting cable pulley is connected to the left side of the top cable guide. A second hoisting cable pulley assembly is connected to the right side of the top cable guide. The top cable guide is disposed on an annular bearing.

A third hoisting cable pulley assembly is disposed on the left side of the jib. A fourth hoisting cable pulley assembly is disposed on the right side of the jib.

The third hoisting cable pulley assembly has a second hoisting cable pulley. The fourth hoisting cable pulley assembly has a first hoisting cable pulley.

The first hoisting cable extends diagonally to a first hoisting cable pulley. The second hoisting cable extends diagonally to a second hoisting cable pulley assembly.

A first hoisting cable crane hook pulley assembly is connected to the crane block for receiving the first hoisting cable from the first hoisting cable crane hook pulley assembly.

A second hoisting cable pulley assembly is connected to the crane block for receiving the second hoisting cable from the second hoisting cable pulley assembly.

The first jib pulley assembly is connected to the right side of the jib and second jib pulley assembly is connected to the left side of the jib.

The cables form a multiple cable fall arrangement between the first hoisting cable crane hook pulley assembly, the second hoisting cable crane hook pulley assembly, and first jib pulley assembly and second jib pulley assembly respectively.

In an alternative embodiment, it is contemplated that the jib connection member rotates about a substantially horizontal jib pivot axis to pivot the jib up toward the top and down toward the foot.

In another embodiment, the hosting crane can have a plurality of sensors to wirelessly detect and transmit locations of the moveable winch support as it rotates about the substantially hollow vertical column.

In yet another embodiment, the hosting crane can have a plurality of hoisting winches and hoisting cables for simultaneous use on the hoisting crane.

In an additional embodiment, the hoisting cable pulley assemblies can engage the hoisting cable in close proximity to the hoisting cable guide.

In another embodiment of the invention, the hoisting crane can further have a telescoping boom disposed on the substantially hollow vertical column.

In another embodiment, a stinger is disposed on the hoisting crane. The stinger is connected to a second topping cable for supplying a contract ballast during lifting and lowering operations. The hoisting crane can have at least one hoisting hook, which is connected to the hosting cable, for engaging a load.

Figure 8:
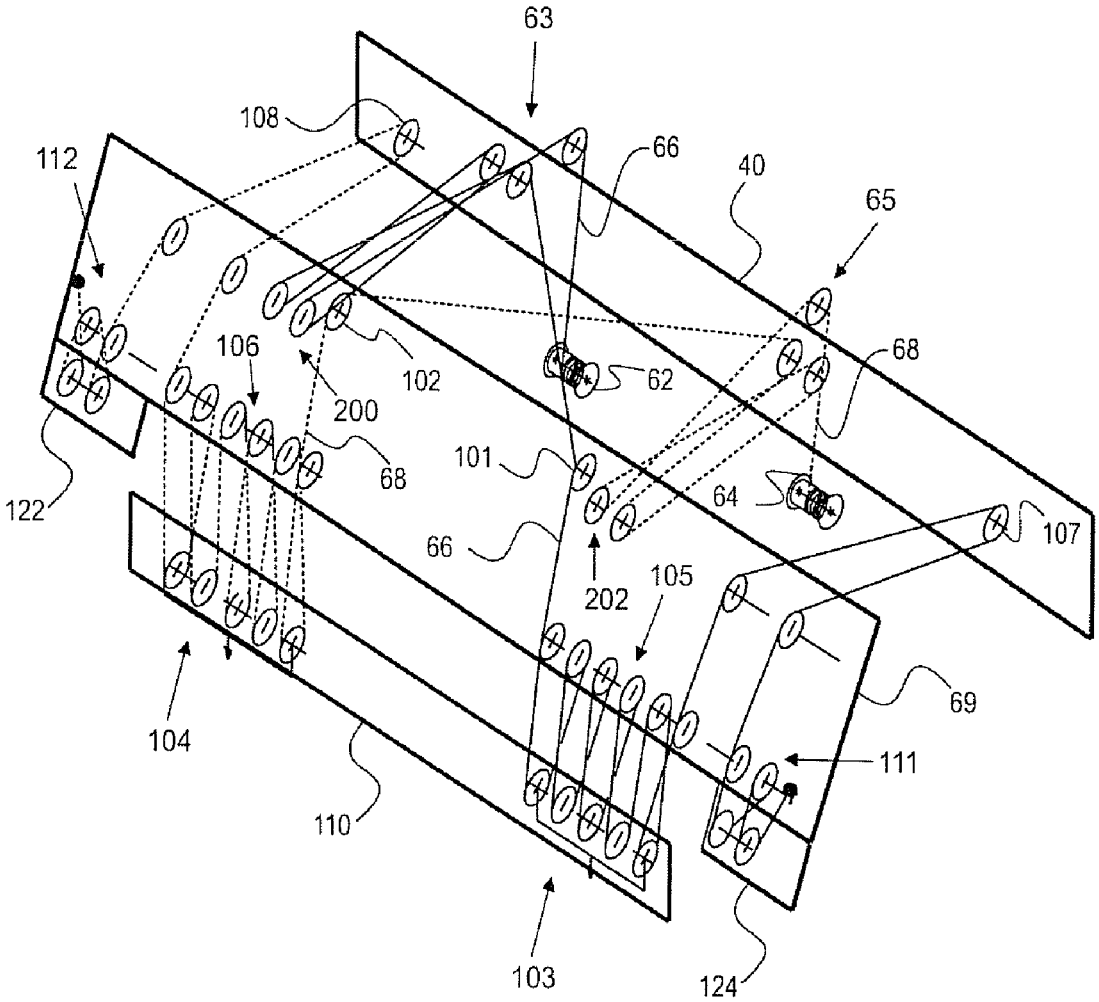
FIG. 8 depicts a possible layout of hoisting cables of the crane.

In FIG. 8, a preferred layout of the hoisting cables of the hosting crane 20 is shown.

In this preferred crane, a first hoisting winch 62 and a second hoisting winch 64, preferably both arranged on a movable winch support 50, as explained above, are employed for hoisting a load suspended from hoisting hook 37, which includes a crane hook block 110.

A first hoisting cable 66 (here shown in solid line) is associated with the first hoisting winch 62, and a second hoisting cable 68 (here shown in dashed line) is associated with the second hoisting winch 64.

The first hoisting cable 66 and the second hoisting cable 68 extend from the first hoisting winch 62 and the second hoisting winch 64 upward through the foot 22 and the substantially hollow vertical column 21 and then arrive at top cable guide 40 of the hosting crane 20. In this drawing, the top cable guide 40 is schematically depicted.

The top cable guide 40 has a left side provided with a first hoisting cable pulley assembly 63 for the first hoisting cable 66 and a right side provided with a second hoisting cable pulley assembly 65 for the second hoisting cable 68.

FIG. 8 further schematically depicts the hoisting cable guide 69 on the jib 24 of the hoisting crane 20. The hosting cable guide 69 has a left side provided with a third hoisting cable pulley assembly 200 for the first hoisting cable 66 and a light side provided with a fourth hoisting cable pulley assembly 202 for the second hoisting cable 68.

The first hoisting cable 66 extends between the first hoisting cable pulley assembly 63 and third hoisting cable pulley assembly 200, the first hoisting cable pulley assembly 63 and the third hoisting cable pulley assembly 200 having three and two pulleys, respectively, in this example.

The second hoisting cable 68 extends here between the second hoisting cable pulley assembly 65 and the fourth hoisting cable pulley assembly 202, the second hosting cable pulley assembly 65 and the fourth hoisting cable pulley assembly 202 having three and two pulleys, respectively in this example.

From the innermost pulley of first hoisting cable pulley assembly 63 the first hoisting cable 66 then extends diagonally to a first hoisting cable pulley 101 mounted on the right side of the hoisting cable guide 69 on the jib 24.

From the innermost pulley of the second hoisting cable pulley assembly 65, the second hoisting cable 68 extends diagonally to a second hoisting cable pulley 102 mounted on the left side of the hoisting cable guide 69 on the jib 24.

The first hoisting cable 66 and second hoisting cable 68 then each extend from the first and second hoisting cable pulley 101, 102 of the hosting cable guide 69 on the jib 24 to a first hoisting cable crane hook pulley assembly 103 and a second hoisting cable crane hook pulley assembly 104 on the right and left side of a crane hook block 110, respectively.

The first hoisting cable crane hook pulley assembly 103 and the second hosting cable crane hook pulley assembly 104 are associated with a first jib pulley assembly 105 and a second jib pulley assembly 106 mounted on the jib 24, such that the first and second hoisting cables 66, 68 extend in a multiple fall arrangement between the first hoisting cable crane hook pulley assembly 103 and the first jib pulley assembly 105 and between second hoisting cable crane hook pulley assembly 104 and second jib pulley assembly 106. The first and second hoisting cable 66, 68 each further extend between the associated first jib pulley assembly 105 and the second jib pulley assembly 106 and the right side and left side of the top cable guide 40, respectively.

A first hoisting cable pulley 107 is mounted on the right side of the top cable guide 40 and a second hoisting cable pulley 108 is mounted on the left side of the top cable guide 40. The hoisting cables each extend around the pulleys 107, 108 and then return to the jib top 159, where the first and second hoisting cable 66, 68 each have a terminal end at the right side and left side of the jib 24 respectively.

In the example depicted, the crane hook block 10 includes additional cable pulley assemblies, a fourth cable pulley assembly 122 and a fifth cable pulley assembly 124, which can be connected to the crane hook block 10 or can be held against the jib 24 (see FIG. 8). The fourth cable pulley assembly 122, fifth cable pulley assembly 124, first associated cable pulley assembly 111, and second associated cable pulley assembly 112 are mounted on the jib 24.

The layout of the hoisting cables shown in FIG. 8 is in particular advantageous for high capacity cranes, more importantly when the top cable guide 40 is arranged in a freely rotatable manner, wherein the top cable guide 40 follows the motions of the jib 24 around the substantially hollow vertical column 21. In case of a failure of one of the first hoisting winch 62 and second hoisting winch 64, the layout shown here causes the top cable guide 40 to maintain its position, which is highly desirable.

A further advantage of the layout shown here is that the first hoisting winch 62 and second hoisting winch 64 can assist in the topping of the jib 24, which allows for a reduction of the capacity of the topping winch 30.

Figure 9:
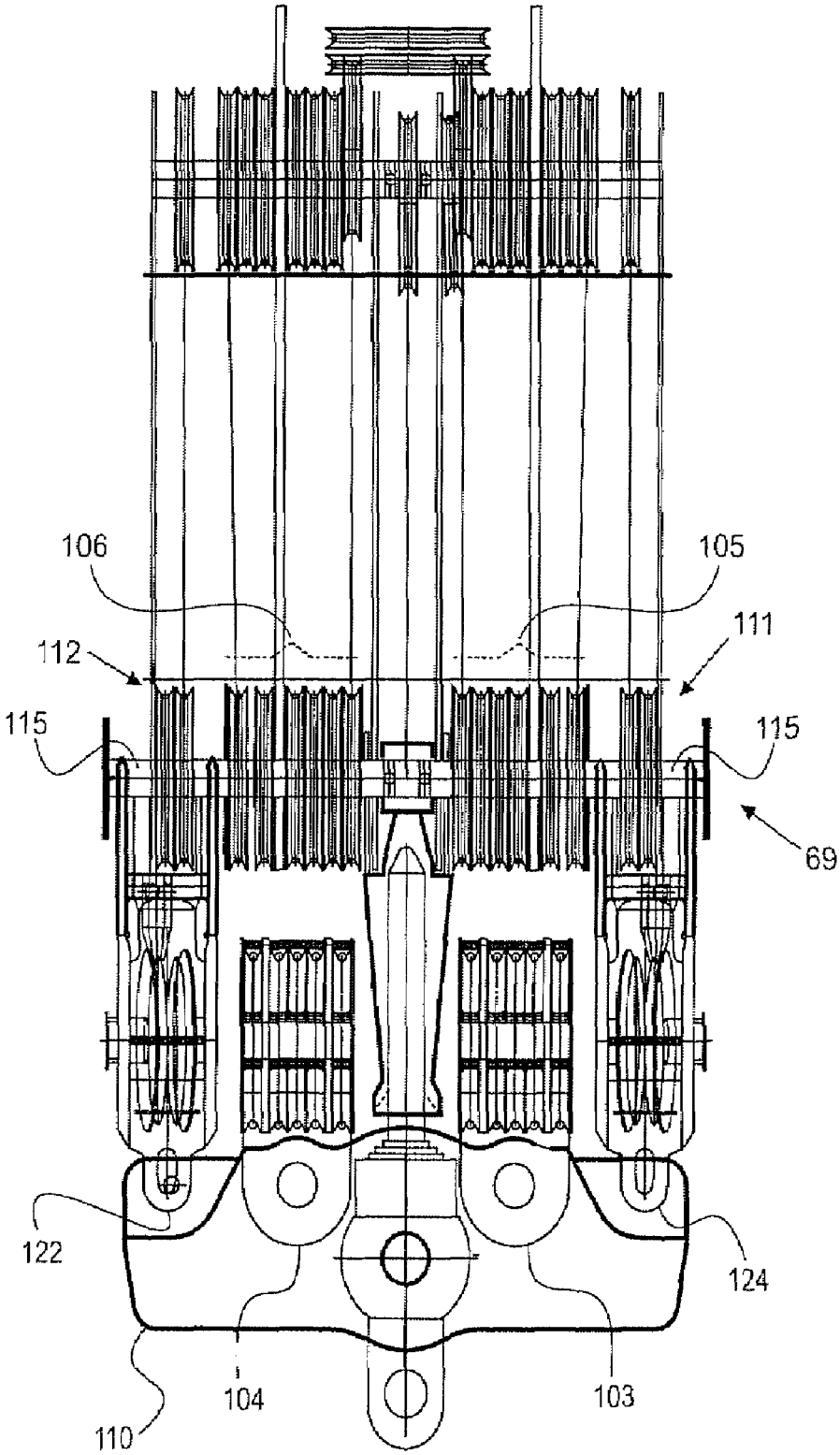
FIG. 9 depicts an embodiment of a crane block, jib, and block catcher device.

In FIG. 9 the crane hook block 110 is shown. FIG. 9 also depicts the first hoisting cable crane hook pulley assembly 1003 and the second hoisting cable crane hook pulley assembly 104 mounted on the crane hook block 110, each having multiple pulleys arranged adjacent each other. Also the fourth cable pulley assembly 122 and the fifth cable pulley assembly 124 are shown here, releasably attached to the crane hook block 110 at the outer ends thereof. Also visible is the hoisting cable guide 69, including numerous cable pulleys, including the first jib pulley assembly 105, the second jib pulley assembly 106, the first associated cable pulley assembly 111, and the second associated cable pulley assembly 112. It is shown that the pulleys of the hoisting cable guide 69 are mounted here on aligned shafts 115.

The crane hook block 110 is, in this example, intended for extreme loads, and the total weight of the crane hook block 110 including the crane hook (not depicted here) could be tens of tons, up to 100 tons.

Figure 10:
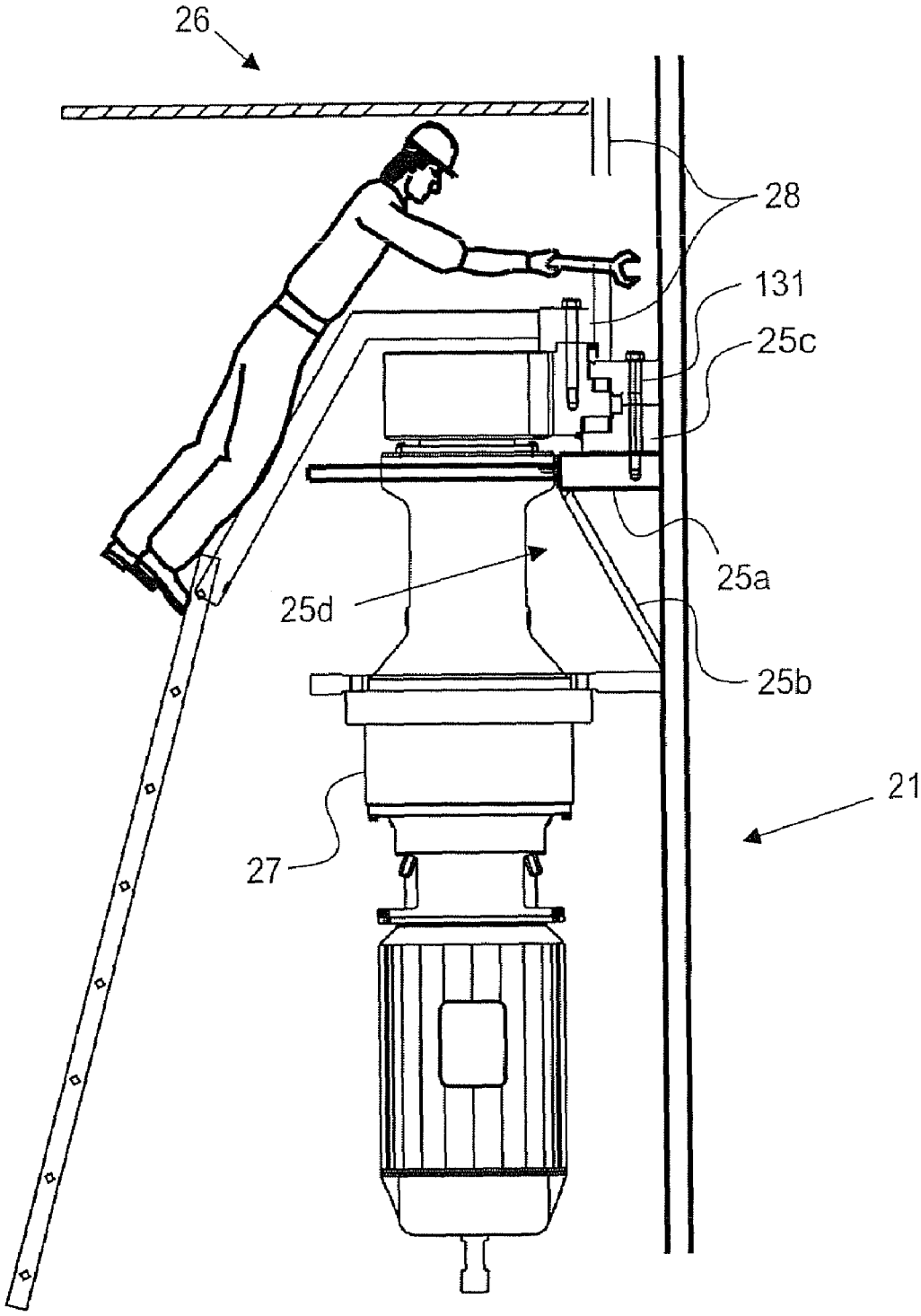
FIG. 10 shows an embodiment of an annular bearing assembly of the crane.

FIG. 10 shows a preferred embodiment of the annular bearing structure 25*d* for the annular component 28 which supports the jib 24. Around the substantially hollow vertical column 21 of the hosting crane 20, a radial support flange 25*a* is fitted. Beneath flange 25*a*, a support cone 25*b* is fitted.

On top of the support flange 25*a*, a guide track structure 25*c* is mounted, which provides a running surface for rollers mounted on the annular component 28. In this example the track structure 25*c* includes a bottom part and an upper part interconnected via bolts 131. These bolts are readily accessible for fastening as shown in FIG. 10.

It is noted that the annular bearing structure 25*d* of triangular cross section can also be used on any type of crane, e.g. a mast crane without a rotatable movable winch support 50.

Figure 11:
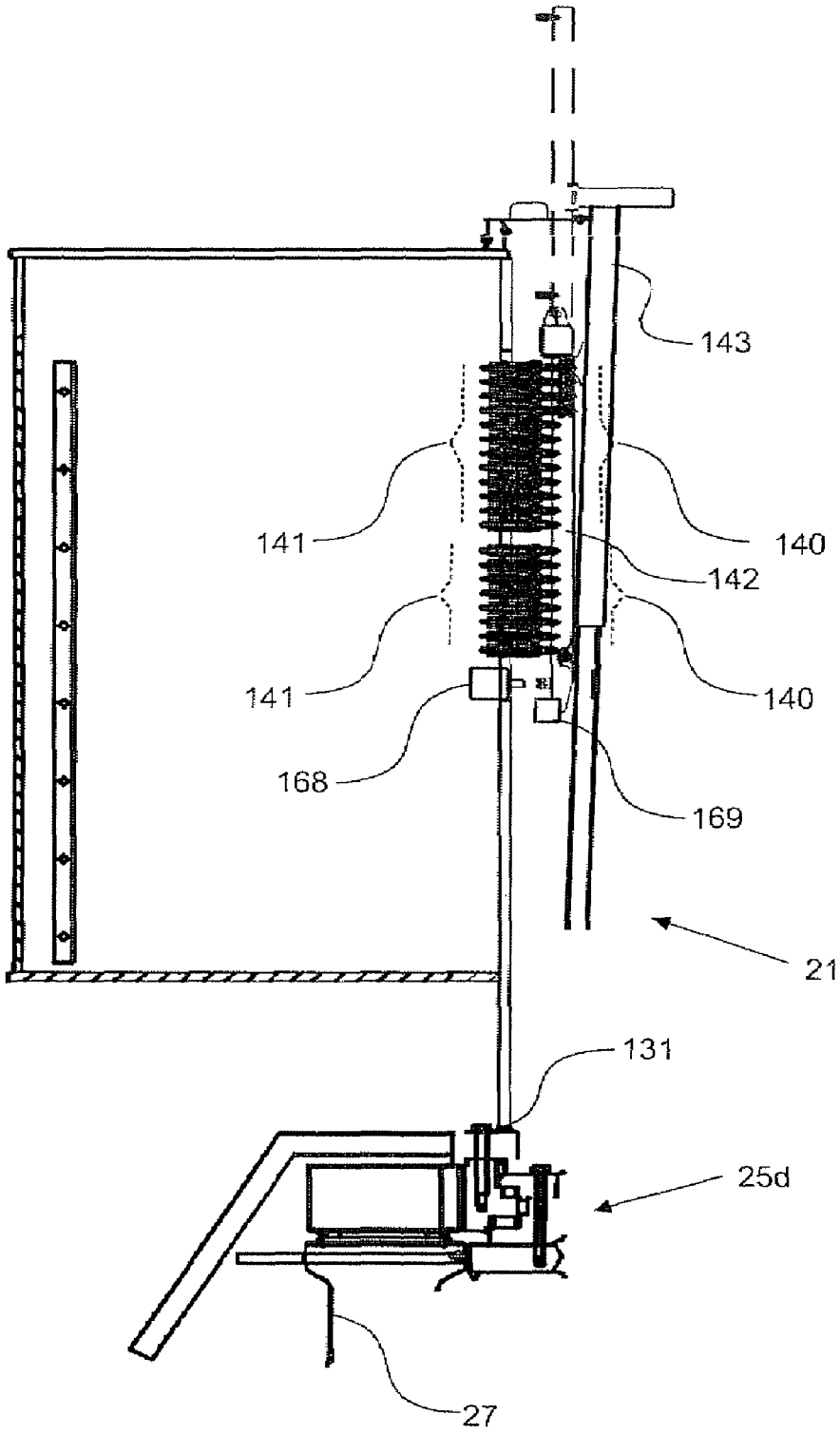
FIG. 11 shows a preferred embodiment of electrical contact rings of the crane.

FIG. 11 depicts schematically a preferred embodiment of the provision of electrical power to electrical equipment mounted rotatably on the substantially hollow vertical column 21, e.g. in the cab 70. For this purpose, a set of electrically conductive contact rings 140 are mounted around the substantially hollow vertical column 21, depicted above the annular bearing structure 25*d*. Electrically conductive contact sliders 141 are mounted to move along the electrically conductive contact rings 140 and provide electrical contact. In order to access the electrically conductive contact rings, such as for repair, the set of electrically conductive contact rings 140 is arranged movable in vertical direction to a raised access position as shown in dashed lines in FIG. 11.

For this purpose, the electrically conductive contact rings 140 are mounted on a common frame 142, which is slidable with respect to associated guides 143 placed along the substantially hollow vertical column 21. One or more actuators, such as vertically arranged screw spindles or hydraulic jacks, could be provided to raise the frame 142 with the rings. One or more of the rings could serve to transmit signals instead of electrical power, e.g. of the open-coax type.

While these embodiments have been described with emphasis on the embodiments, it should be understood that within the scope of the appended claims, the embodiments might be practiced other than as specifically described herein.

What is claimed is:

1. A hoisting crane with an even reeving system comprising:

a. a substantially hollow vertical column (21) comprising a foot (22), a top (23), and a body (19) disposed between the foot (22) and the top (23);

b. an annular bearing structure (25*d*) disposed around the substantially hollow vertical column (21);

c. a jib connection member (26) disposed on the annular bearing structure (25*d*) and rotatable about the substantially hollow vertical column (21);

d. a jib (24) connected to the jib connection member (26);

e. a first hoisting winch (62) disposed on a moveable winch support (50) connected to a first hoisting cable (66) and a second hoisting winch (64) disposed on the moveable winch support (50) connected to a second hoisting cable (68), wherein both hoisting cables pass through the interior of the substantially hollow vertical column (21) to a top cable guide (40) disposed on an annular bearing (94), and wherein the first hoisting cable (66) engages a first hoisting cable pulley assembly (63) connected to the left side of the top cable guide (40) and a second hoisting cable pulley assembly (65) connects to the right side of the top cable guide (40);

f. wherein a third hoisting cable pulley assembly (200) is disposed on the left side of the jib (24) and a fourth hoisting cable pulley assembly (202) is disposed on the right side of the jib (24), wherein the third hoisting cable pulley assembly (200) comprises a second hoisting cable pulley (102) and wherein fourth hoisting cable pulley assembly (202) comprises a first hoisting cable pulley (101);

g. wherein said first hoisting cable (66) extends diagonally to a first hoisting cable pulley (101), and wherein said second hoisting cable (68) extends diagonally to a second hoisting cable pulley (102);

h. wherein a first hoisting cable crane hook pulley assembly (103) is connected to the crane hook block (110) for receiving the first hoisting cable (66) from the first hoisting cable crane hook pulley assembly (103) and a second hoisting crane hook cable pulley assembly (104) connected to the crane hook block (110) for receiving the second hoisting cable (68) from the second hoisting cable crane hook pulley assembly (104);

i. wherein a first jib pulley assembly (105) is connected to the right side of the jib (24) and a second jib pulley assembly (106) is connected to the left side of the jib (24); and j. wherein the cables form a multiple cable fall arrangement between the first hoisting cable crane hook pulley assembly (103), the second hoisting cable crane hook pulley assembly (104) and the first jib pulley assembly (105) and the second jib pulley assembly (106) respectively.

2. The hoisting crane with an even reeving system of claim 1, wherein the hoisting crane is on a floating vessel (1).

3. The hoisting crane with an even reeving system of claim 1, wherein the jib connection member (26) rotates about a substantially horizontal pivot axis (92) to pivot the jib (24) up toward the top (23) and down toward the foot (22).

4. The hoisting crane with an even reeving system of claim 1, further comprising a plurality of sensors to wirelessly detect and transmit locations of the moveable winch support (50) as it rotates about the substantially hollow vertical column (21).

5. The hoisting crane with an even reeving system of claim 1, further comprising a plurality of hoisting winches and hoisting cables for simultaneous use on the hoisting crane.

6. The hoisting crane with an even reeving system of claim 1, wherein the hoisting cable pulley assemblies engage the hoisting cables in close proximity to the hoisting cable guide (69).

7. The hoisting crane with an even reeving system of claim 1, further comprising a telescoping boom (801) disposed on the substantially hollow vertical column (21).

8. The hoisting crane with an even reeving system of claim 1, further comprising a stinger (5) disposed on the hoisting crane (20) connected to a second topping cable (220) for supplying a contract ballast during lifting and lowering operations.

* * * * *